US012290761B2

(12) United States Patent
Tezuka et al.

(10) Patent No.: US 12,290,761 B2
(45) Date of Patent: May 6, 2025

(54) INTERACTIVE TOY

(71) Applicant: LEGO A/S, Billund (DK)

(72) Inventors: Takashi Tezuka, Kyoto (JP); Hiroshi Momose, Kyoto (JP); Emi Makiuchi, Kyoto (JP); Jonathan B. Bennink, Billund (DK); Jonathan Trier, Billund (DK); Benjamin Ma, Billund (DK)

(73) Assignee: LEGO A/S, Billund (DK)

( * ) Notice: Subject to any disclaimer, the term of this patent is extended or adjusted under 35 U.S.C. 154(b) by 576 days.

(21) Appl. No.: 17/764,610

(22) PCT Filed: Sep. 21, 2020

(86) PCT No.: PCT/EP2020/076257
§ 371 (c)(1),
(2) Date: Mar. 29, 2022

(87) PCT Pub. No.: WO2021/063721
PCT Pub. Date: Apr. 8, 2021

(65) Prior Publication Data

US 2022/0355218 A1 Nov. 10, 2022

(30) Foreign Application Priority Data

Sep. 30, 2019 (DK) ..... PA201970608

(51) Int. Cl.
*A63H 33/00* (2006.01)
*A63H 33/04* (2006.01)

(52) U.S. Cl.
CPC ..... *A63H 33/042* (2013.01); *A63H 2200/00* (2013.01)

(58) Field of Classification Search
CPC .. A63H 33/042; A63H 2200/00; A63H 33/26; G06K 17/0025; G06K 17/0029; G06F 3/0488
(Continued)

(56) References Cited

U.S. PATENT DOCUMENTS 5,913,727 A 6/1999 Ahdoot
6,165,068 A 12/2000 Sonoda et al.
(Continued)

FOREIGN PATENT DOCUMENTS

JP 2011130829 A2 7/2011
WO 2000/079403 A2 12/2000
(Continued)

OTHER PUBLICATIONS

Search Report issued in corresponding Danish Patent Application No. PA 2019 70608, dated Mar. 4, 2020, 4 pages.
(Continued)

*Primary Examiner* — Nini F Legesse
(74) *Attorney, Agent, or Firm* — Day Pitney LLP; George Chaclas; Anthony A. Kassas

(57) ABSTRACT

An electronic toy including a sensor for detecting movement, a reader for detecting markers in a proximity of the electronic toy, a user-interface for providing a user-perceptible output, and a processing unit. The processing unit is configured to control the user-interface responsive to a detected movement and a detected marker, enter an active play state responsive to a first trigger event representative of a start of a play activity, process information about movements detected by the sensor while the processing unit is in the active play state and information about markers detected by the reader while the processing unit is in the active play state to compute a result score associated with the play activity, control the user-interface to provide a user-perceptible output based on the computed result score, and exit the active play state responsive to a second trigger event representative of an end of a play activity.

12 Claims, 7 Drawing Sheets

(58) Field of Classification Search
USPC ..... 446/91, 268
See application file for complete search history.

(56) References Cited

U.S. PATENT DOCUMENTS

| | | | | |
|---|---|---|---|---|
| 6,213,872 | B1 | 4/2001 | Harada et al. | |
| 6,257,948 | B1 | 7/2001 | Silva | |
| 6,290,565 | B1 | 9/2001 | Galyean et al. | |
| 6,443,796 | B1 | 9/2002 | Shackelford | |
| 6,551,165 | B2 | 4/2003 | Smirnov | |
| 6,761,637 | B2 | 7/2004 | Weston et al. | |
| 6,834,249 | B2 | 12/2004 | Orchard | |
| 7,066,781 | B2 | 6/2006 | Weston | |
| 8,232,879 | B2 | 7/2012 | Davis | |
| 8,681,005 | B2 | 3/2014 | Austin et al. | |
| 8,845,384 | B2 | 9/2014 | Ghaly | |
| 8,876,604 | B2 | 11/2014 | Casino et al. | |
| 9,259,651 | B1 | 2/2016 | Yano | |
| 9,333,427 | B2 | 5/2016 | Sabo et al. | |
| 9,446,319 | B2 * | 9/2016 | Barney | A63F 13/25 |
| 9,542,579 | B2 | 1/2017 | Mangold et al. | |
| 9,757,624 | B2 | 9/2017 | Binder | |
| 10,037,029 | B1 * | 7/2018 | Russell | G08G 1/166 |
| 10,625,173 | B2 | 4/2020 | Kærsgaard et al. | |
| 2002/0193160 | A1 | 12/2002 | Tarantino | |
| 2004/0214642 | A1 | 10/2004 | Beck | |
| 2005/0208458 | A1 | 9/2005 | Smith et al. | |
| 2008/0014830 | A1 | 1/2008 | Sosnovskiy et al. | |
| 2008/0081694 | A1 | 4/2008 | Hong et al. | |
| 2008/0139080 | A1 | 6/2008 | Zheng | |
| 2008/0153594 | A1 | 6/2008 | Zheng | |
| 2011/0053173 | A1 | 3/2011 | Hood et al. | |
| 2012/0218299 | A1 | 8/2012 | Hayakawa | |
| 2014/0273721 | A1 | 9/2014 | Katan et al. | |
| 2015/0290545 | A1 | 10/2015 | Barney et al. | |
| 2015/0325079 | A1 | 11/2015 | Alsip | |
| 2016/0029962 | A1 | 2/2016 | Hyde et al. | |
| 2017/0018980 | A1 | 1/2017 | Yang et al. | |
| 2017/0113131 | A1 | 4/2017 | Doptis et al. | |
| 2017/0144083 | A1 | 5/2017 | Kærsgaard et al. | |
| 2019/0009181 | A1 | 1/2019 | Kroyan et al. | |
| 2019/0209932 | A1 | 7/2019 | Schwarz et al. | |

FOREIGN PATENT DOCUMENTS

| | | | |
|---|---|---|---|
| WO | 2003/043709 | A1 | 5/2003 |
| WO | 2017/100821 | A1 | 6/2017 |
| WO | 2018215740 | A2 | 11/2018 |
| WO | 2020001789 | A1 | 1/2020 |
| WO | 2020156719 | A1 | 8/2020 |
| WO | 2020156720 | A1 | 8/2020 |
| WO | 2022053662 | | 3/2022 |

OTHER PUBLICATIONS

International Search Report and Written Opinion issued in corresponding International Patent Application No. PCT/EP2020/076257, mailed Nov. 25, 2020, 9 pages.
DK Search Report in Application No. PA 2020 70589, Completion of Search Report dated Mar. 10, 2021, 4 pages.
International Search Report in International Application No. PCT/EP2021/075037, dated Jan. 4, 2022, 3 pages.
Written Opinion in International Application No. PCT/EP2021/075037, dated Jan. 4, 2022, 7 pages.
CN Office Action corresponding to U.S. Appl. No. 17/764,610, dated Sep. 8, 2023, 6 pages.

* cited by examiner

INTERACTIVE TOY

The present application claims the benefit of and priority to DK Patent Application No. PA201970608 dated Sep. 30, 2019, and is a U.S. national stage application under 35 U.S.C. 371 of co-pending International Application No. PCT/EP2020/076257 filed on Sep. 21, 2020, the contents of each are incorporated by reference herein in their entirety for all purposes.

TECHNICAL FIELD

The present disclosure relates to interactive electronic toys.

BACKGROUND

Many interactive electronic toys are known in the art.

WO 03/043709 discloses a toy or game play apparatus or method involving a powered host or master unit which operates interactively with one or more nonself-powered play objects. The host has a preprogrammed microcontroller and an RFID reader/interrogator circuit. Each play object has a RFID tag IC. When the host and a play object are positioned so as to afford RF communication between them, the host sends power to energize the tag IC of the play object. The host recognizes that transmitted data and makes a presentation to the user caused by that transmitted data. Some or even all of the presentation may be the data from the play object.

Nevertheless, it generally remains desirable to provide interactive toys that provide a variety of entertaining play experiences.

It is further generally desirable to provide electronic toys at relatively low costs.

It is further desirable to provide an electronic toy that provides an easy-to-use, yet entertaining and versatile interaction with the electronic toy.

SUMMARY

According to one aspect, disclosed herein are embodiments of an electronic toy, comprising:

- a sensor for detecting movement of the electronic toy;
- a reader for detecting markers in a proximity of the electronic toy;
- a user-interface for providing a user-perceptible output;
- a processing unit configured to control the user-interface responsive to a detected movement and to a detected marker.

The control of the behavior of an electronic toy based on a combination of a sensed movement of the electronic toy and a detected marker provides interesting game play while providing an easy-to-use interaction.

The control of the behavior of an electronic toy based on a combination of a sensed movement of the electronic toy and a detected marker further provides interesting game play while keeping manufacturing costs low.

In some embodiments, the processing unit is configured to

- enter an active play state responsive to a first trigger event, e.g. responsive to detecting a first marker, the first marker being representative of a start of a play activity;
- exit the active play state responsive to a second trigger event, e.g. responsive to detecting a second marker, the second marker being representative of an end of a play activity;

- process information about movements detected by the sensor while the processing unit is in the active play state and/or information about markers detected by the reader while the processing unit is in the active play state to compute a result score associated with the play activity; and
- control the user-interface to provide a user-perceptible output based on the computed result score.

Alternatively, the play activity may be started and/or terminated based on a user input to the electronic toy, e.g. by the user pushing a button or activating another user-interface element of the electronic toy, e.g. a touch screen. In some embodiments, the play activity may be terminated by other criteria, e.g. the computed result score reaching a predetermined threshold or an expiry of a timer.

Accordingly, in some embodiments, the electronic toy comprises one or more user-interface elements; and the processing unit is configured to

- enter an active play state responsive to a first user-activation of at least one of the one or more user-interface elements or responsive to detecting a first marker, the first marker being representative of a start of a play activity or the first user-activation being representative of a start of a play activity;
- exit the active play state responsive to detecting a second user-activation of at least one of the one or more user-interface elements, the second user-activation being representative of an end of a play activity, or responsive to detecting a second marker, the second marker being representative of an end of a play activity;
- process information about movements detected by the sensor while the processing unit is in the active play state and about markers detected by the reader while the processing unit is in the active play state to compute a result score associated with the play activity; and
- control the user-interface to provide a user-perceptible output based on the computed result score.

It will be appreciated that, in some embodiments, the play experience may be started by the user activating a user-interface element and ended by reading a corresponding marker. Alternatively, the play experience may be started by reading a marker and ended by the user activating a user-interface element. Similarly, the start and end of the play activity may be triggered by respective activation of a single user-interface element, e.g. by repeated pressing a button, where the first activation starts the play activity and a second, subsequent activation ends the play activity. Alternatively, the electronic toy may include separate user-interface elements for starting and ending the play activity, respectively.

The electronic toy may be configured to perform different types of play activities, e.g. play activities may include different rules for computing the result score and/or different feedback by the electronic toy. For example, the first marker or the first user-activation may be indicative of a type of play activity; and the computed result score may not only depend on the detected movement and/or the detected markers while the processing unit is in the active play state, but also on the selected type of play activity. Accordingly, the toy system may include different type of markers, e.g. including markers indicative of different play activities. Similarly the computed result score and/or the output presented via the user-interface may depend on the types of markers detected while the electronic toy is in the active play state. To this end the processing unit may be configured to process information about movements detected by the sensor while the processing unit is in the active play state and/or information about detected markers, including information about which types of markers are detected by the reader while the processing unit is in the active play state to compute a result score associated with the play activity influence on the result score. Hence, the same detected movement pattern may have a different effect on the computed result score and/or in the created output by the electronic toy, depending on which type of marker has been detected before, during and/or after the detected movement.

For example, in one type of play activity a high score is computed when many rotations of the electronic toy are recorded between consecutive detections of a third marker. In another type of play activity, a high result score is computed when fast vibrations of the electronic toy are recorded between consecutive detections of a third marker. In yet another type of play activity, a high result score is computed when many different markers and/or a predetermined sequence of different markers is detected within a short period of time.

Accordingly, in some embodiments, the user-perceptible output which is based on the computed result score may further depend on the elapsed time during which the processing unit is in the active play state (i.e. between detecting the first marker and detecting the second marker or between the first and the second user-activation etc.)

In some embodiments, the processing unit is configured to control the user interface responsive to a detected movement and a detected marker, wherein the movement and the marker are detected to have a predetermined temporal relation with each other, such as detected concurrently, within a predetermined time period, in a predetermined sequential order, etc. or a combination thereof. Alternatively or additionally, the computed result score may depend on a detected predetermined temporal relation of the detection of a marker and the detection of a movement with each other, such as detected concurrently, within a predetermined time period, in a predetermined sequential order, etc. or a combination thereof.

The detected movement may include a movement pattern, e.g. a rotation, tilt, vibration and/or the like. The processing unit may process the detected signals from the sensor for detecting movement so as to determine one or more attributes of the movement, such as one or more frequencies of a vibration, an amplitude of a vibration, a speed of movement, an orientation of a rotation, etc. The processing unit may base the control of the user-interface and/or the computed result score on the determined attribute.

The result score may be computed based on input from the reader and from the sensor for detecting movement as the only sensor inputs. It will be appreciated that the computed result score may further depend on elapsed time and other factors, e.g. the current game state, earlier result scores, user input and/or the like.

The user-interface may include a display and/or a loudspeaker, and/or other devices for providing user-perceptible output, in particular visible, audible and/or tactile output.

The reader may be an RFID reader, a camera or other optical sensor for reading QR codes, detecting colors, reading color codes, reading micro-dot patterns and/or the like.

The sensor for detecting movement may be an accelerometer or other suitable device for detecting accelerations, vibrations, and/or other indicators of a movement of the electronic device. In some embodiments, the sensor comprises a multi-axes accelerometer, such as a triaxial accelerometer or a 6-axis accelerometer.

The electronic toy may comprise a housing accommodating the reader, the sensor and the user-interface. For example, the housing may have a shape representing a character.

The electronic toy may be part of a toy system, the toy system including the electronic toy and accessories to the electronic toy, such as clothing, tools, weapons, etc. that can be removable attached to the electronic toy. In some embodiments, the electronic toy may be configured to detect and recognize one or more of the accessories when the accessory is attached to the electronic toy. To this end the accessories may comprise respective markers identifying the electronic toy. Alternatively, the electronic toy may be configured to otherwise detect attachment of an accessory, e.g. by mechanical activation of one or more switches, by electrical contact, by RFID or other contactless technology, etc.

In some embodiments, the electronic toy may be a toy construction element compatible with a toy construction system. In particular, the electronic toy may comprise coupling members configured for detachable attachment to other toy construction elements of the toy construction system. For example, the toy construction system may include accessories that can be detachably attached to the electronic toy by means of said coupling members.

In some embodiments, the toy construction system comprises marker construction elements. The marker construction elements may each comprise coupling members for detachable attachment to other toy construction elements of the toy construction system, and the marker construction elements may be detectable and recognizable by the reader. To this end, and depending on the type of reader, the marker construction elements may include an RFID tag and/or a visually detectable feature such as a QR code, a predetermined color, a color code, a micro-dot pattern, a recognizable insignia, etc. In other embodiments other forms of markers may be used e.g. adhesive stickers or other physical markers that can be attached, preferably in a detachable manner, to a toy construction element.

Hence, the toy construction system may be configured to allow the user to construct one or more toy construction models, each comprising one or more markers, e.g. one or more marker construction elements. The user may thus construct an arena, track or other physical play environment. During game play, the user may move the electronic toy about the thus constructed physical play environment and the electronic toy may detect one or more of the markers, when the electronic toy is brought into sufficient proximity of the markers. The electronic toy may further detect its own movements and provide user-perceptible outputs based on the detected movements and detected markers.

The active play state may be one of a plurality of operational states implemented by the electronic toy. The plurality of operational states may include a stand-by state and one or more active play states, e.g. each corresponding to a different play activity. The plurality of operational states may further include a free-play state in which the processing unit is configured to control the user-interface responsive to detected movements and detected marker, but without computing a result score. In some embodiments, the operational states may include only a single state, e.g. only a free-play state in which no result score is computed but where the electronic provides user-perceptible outputs responsive to detected markers and/or responsive to detected movements. Alternatively, the single state may be an active play state in which a result score is computed. In some embodiments, the operational states may include a free-play state, one or more active play states and, optionally, an energy-conserving state and/or stand-by state. Upon activation of the electronic toy—e.g. upon power-up or upon activation from the energy-conserving state—the electronic toy may initially enter the free-play state or a stand-by state. The electronic toy may then enter an active play state from the free-play state responsive to a trigger event as described herein. Upon completion of an active play-state, the electronic toy may enter the free-play state, a stand-by state or a different state.

DETAILED DESCRIPTION

Figure 1:
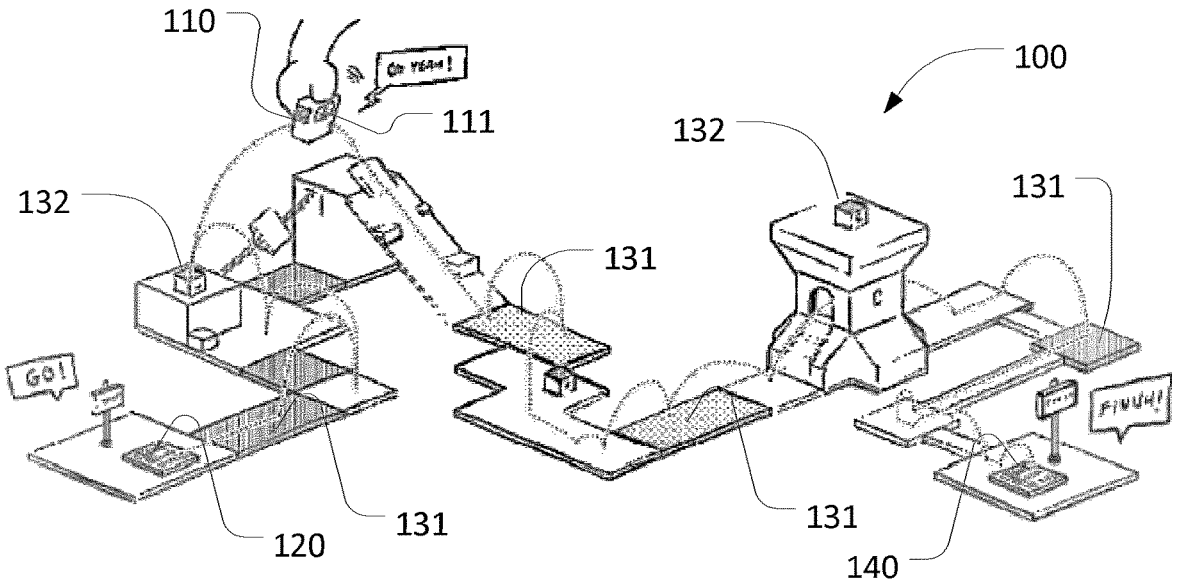
FIGS. 1-11 and 12A-B illustrate examples of a toy system.

FIG. 1 illustrates an example of a toy system comprising a physical play environment, generally designated by reference numeral 100, constructed from toy construction elements. The toy system further comprises an electronic toy 110 which a user can move about the physical play environment 100. The electronic toy 110 comprises an accelerometer for detecting movements and an optical reader configured to detect markers: One type of marker 132 includes a visible code, such as a microdot pattern, a QR code or the like; while the other markers 131 are colored tiles or other colored toy construction elements. However, it will be appreciated that other types of markers, such as visible markers, RFID markers, etc., may be used. The electronic toy 110 resembles a character. In this example, the reader is facing downwards when the electronic toy is oriented for normal use, i.e. configured to detected markers onto or above which the electronic toy is placed. The normal orientation of the electronic toy may be defined by the shape of the toy (e.g. when resembling a figurine), the orientation of a display and/or in a similar manner. The electronic toy 110 further comprises a display 111 and a loudspeaker for providing visible and audible feedback.

The user initiates a play activity by holding the electronic toy in contact or close proximity to a start marker 120 so as to allow the optical reader to detect the start marker. Responsive to detecting the start marker, the electronic toy enters an active play state. In some embodiments, the toy system includes different start markers, each indicative of a respective type of play activity. Alternatively or additionally, different types of play activities may be selected based on other criteria, e.g. a user input to the electronic toy, communication with another electronic toy or with a processing device, based on previously completed play experiences, a progression level of the electronic toy, etc. A progression level may e.g. be stored by the electronic toy and/or by a remote processing device with which the electronic toy is communicatively connected.

Generally, while in the active play state, the electronic toy detects movements of the electronic toy and it detects one or more markers, e.g. toy construction elements having predetermined color(s) or other visual markers, when the electronic toy is brought in proximity of said markers.

When the electronic toy detects a finish marker 140, the electronic toy exits the active play state and computes a result score which depends on the movements and markers that have been detected while the electronic toy was in the active play state. It will be appreciated that the result score may be computed and updated in real time while the electronic toy is in its active play state or it may be computed once the electronic toy has exited the active play state. It will be appreciated that, in some embodiments of the toy system described herein, the electronic toy may be configured to create audible and/or visible feedback responsive to detected movements and/or responsive detected markers, e.g. during the play activity or even when no play activity has been initiated by detecting a start marker, i.e. when the electronic toy is not currently in an active play state. In such an embodiment, the electronic toy may be configured to operate in a free-play state instead. It will further be appreciated that the type of feedback and the rules and conditions for the creation of respective feedback may differ depending on which state the electronic toy is operated in, e.g. which active play state or free-play state.

The computation of the result score may be based on a set of game rules where different types of play activities may have different game rules associated with them. The game rules may thus be stored by the electronic toy and/or by a remote processing device with which the electronic toy is communicatively connected.

The computation of the result score may further depend on one or more other parameters, such as an elapsed time between detection of the start marker and detection of the finish marker, on any recognized accessories attached to the electronic toy and/or the like.

Figure 2:
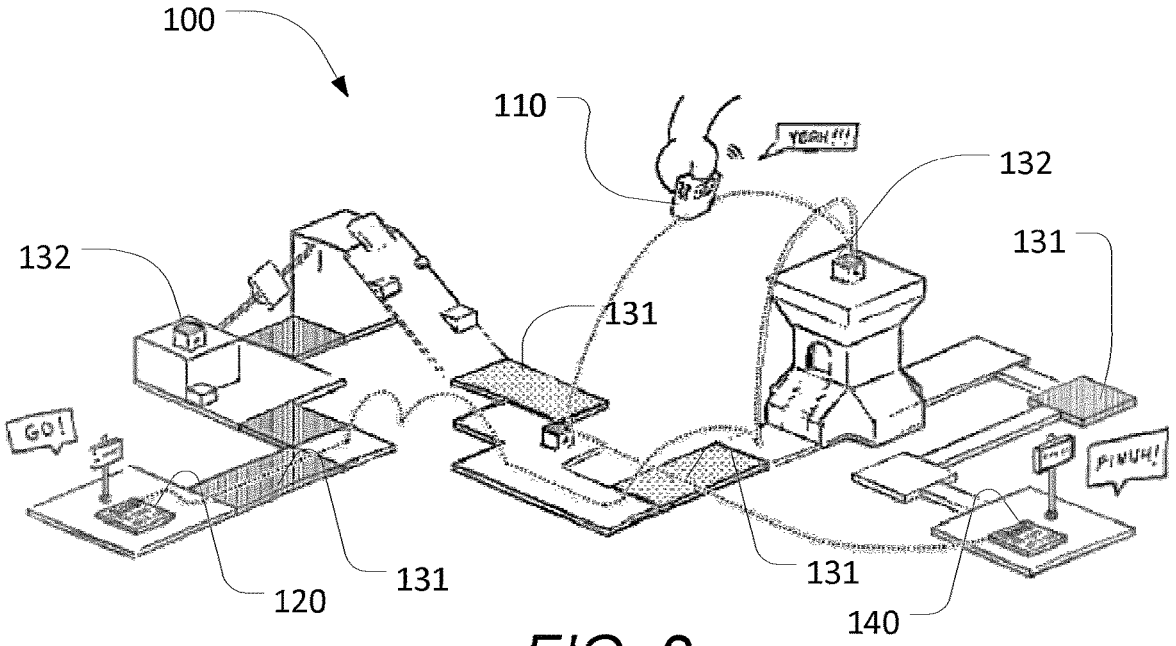

Hence, the score depends on how the user moves the electronic toy about the play environment between the start and finish markers, i.e. on the movements and/or on the detected markers. For example, FIG. 2 shows the same physical play environment as in FIG. 1, but where the user moves the electronic toy 110 along a different path, thus resulting in a different result score.

Similarly, the computed result score also depends on the type of markers (e.g. on the colors of the toy construction elements from which the physical play environment is constructed) and/or from the relative positions of the markers.

Figure 3:
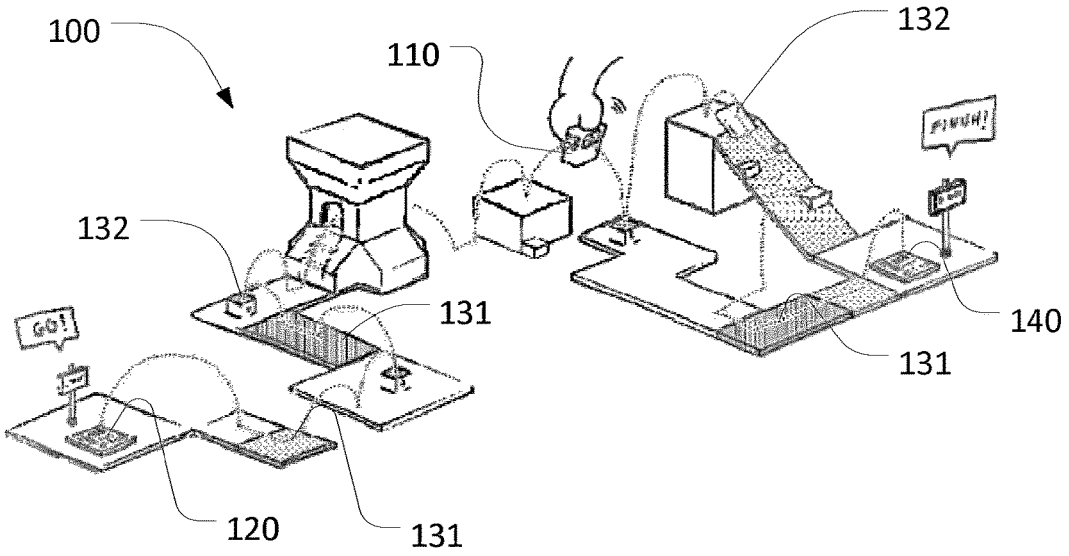

It will be appreciated that the play environment 100 may be in the form of a single coherent toy construction model where all parts of the model are interconnected with a single structure. In other embodiments, the play environment may include multiple separate structures that may be positioned independently of each other. For example, FIG. 3 shows a different example of a physical play environment 100. In this example, not all parts of the physical play environment are interconnected with each other.

Generally, in one play activity, detection of one type of marker may cause a result score to be increased by a certain value, e.g. by a predetermined, random or otherwise determined value. For example, the result score may reflect an amount of an in-game currency, e.g. symbolized by virtual coins, stars or other virtual items. Collected coins may be used in the game for achieving in-game advantages, e.g. for obtaining capabilities, unlocking new games, advancing in an existing game, etc.

In some embodiments, a play activity may have a maximum duration associated with it. For example, such duration may be implemented by requiring that the electronic toy detects the marker representing the end of the play activity within a certain period of time after detection of the marker representing the start of the play activity. In some embodiments, detection of one type of marker during the play activity may cause the maximum duration to be extended.

One type of marker may cause an effect of the result score only after repeated detection of said marker during the play activity, or otherwise an effect on the result score that depends on the number of times the marker has been detected during the play activity. For example, one type of marker may represent an enemy which has to be touched multiple times in order to be defeated, e.g. multiple times within a certain period of time. This activation may thus simulate an enemy toy figure that has a simulated health value. When hit (as simulated by the electronic toy detecting a marker attached to the enemy figure), the health value of the enemy is reduced. When the health value reaches a minimum threshold due to repeated "hits", the result score computed by the processing unit of the electronic toy may be increased.

Yet further examples include markers that have a random or chance effect on the result score. Yet further examples include markers whose effect on the result score depends on the duration of detection, i.e. on how long the electronic toy is in a sufficient proximity to the marker for the marker to be detected.

Yet further examples include markers whose effect on the result score depends on the order in which they are detected or otherwise on the combination of detection of multiple markers. For example, one marker may represent a key where detecting the marker represents the electronic toy picking up a key. Another marker may represent a locked item, e.g. a treasure chest, a door, etc. that can be unlocked when the marker is detected during a play activity, but only after the electronic toy has already detected the marker representing the key during the same play activity.

Figure 4:
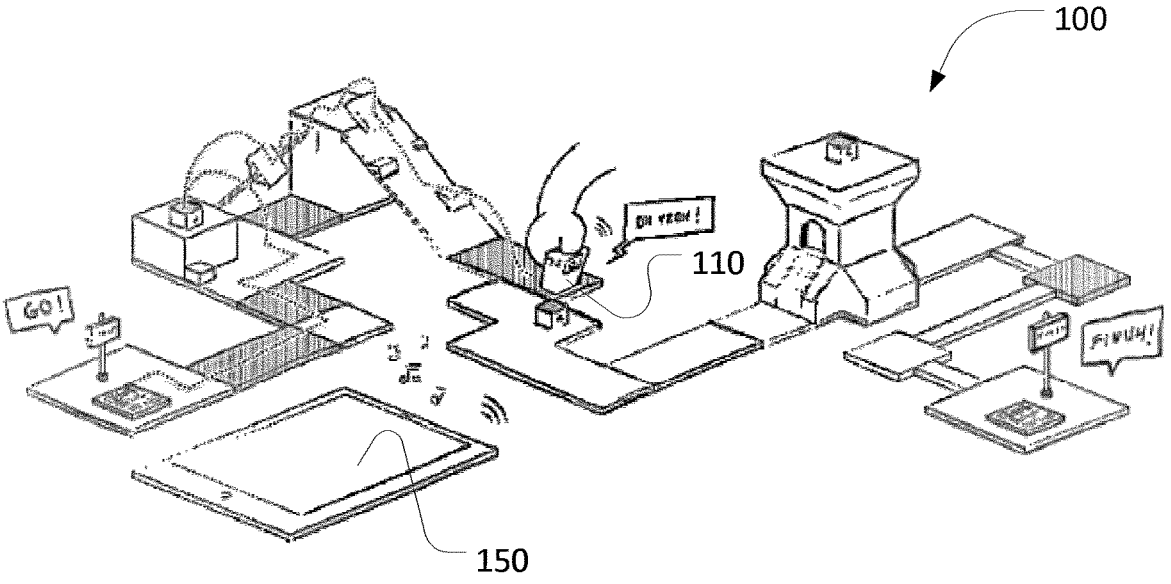

In some embodiments, e.g. as illustrated in FIG. 4, the toy system comprises a processing device 150, such as a smartphone, a tablet computer or another type of computer, another electronic toy, etc. The electronic toy 110 may be configured to wirelessly communicate with the processing device 150, e.g. via Bluetooth low energy or another suitable communication technology, such as RF or IR communication. This allows the processing device 150 to provide a digital play experience corresponding to the movements and detected tags by the electronic toy 110. The processing device 150 may also be used to maintain usage data, e.g. game progression data etc. Moreover, the processing device 150 may be used to allow the user to select different types of game experiences or to reconfigure the electronic toy.

Figure 5:
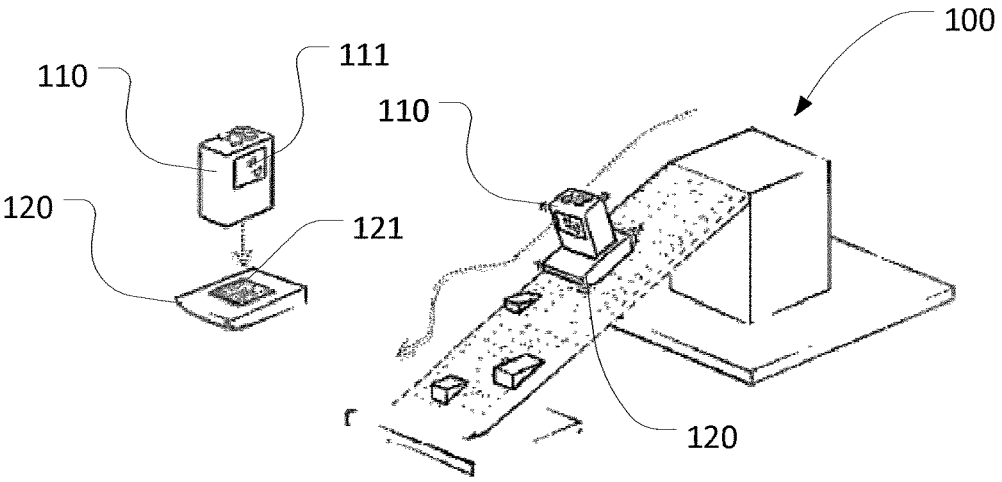

FIG. 5 illustrates another example of a toy system comprising a physical play environment 100 constructed from toy construction elements. The toy system further comprises an electronic toy 110 which a user can move about the physical play environment. The electronic toy comprises an accelerometer for detecting movements and an optical reader configured to detect different types of markers, e.g. as described in connection with one or more of the previous embodiments. As in the previous example, the reader is facing downwards, i.e. configured to detected markers onto or above which the electronic toy is placed.

The toy system further comprises an accessory construction element 120, e.g. in the form of a support platform, which includes a marker 121. When the electronic toy 110 is brought into contact with, or at least into sufficient proximity of, the accessory construction element such that the reader of the electronic toy 110 can detected the marker 121, the electronic toy 110 is configured to enter an activity play mode which depends on the type of the marker 121.

In some embodiments, the accessory construction element may be configured to allow the electronic toy 110 to be brought in loose contact with the accessory construction element 120, e.g. by allowing the electronic toy to stand on top of the accessory construction element. In other embodiments, the accessory construction element and the electronic toy may be configured to provide a certain degree of attachment between the electronic toy and the accessory construction element or otherwise include means for retaining the electronic toy in contact or proximity with the accessory to construction element. For example, the accessory construction element may include a recess shaped and sized to receive the electronic toy. Hence, in such embodiments the electronic toy is at least to some degree prevented from being easily removed from the accessory construction element. Alternatively or additionally, the electronic toy may be retained in contact with the accessory construction element by a magnet or other form of coupling members. In some embodiments, the accessory construction element 120 and the electronic toy 110 may include mutually compatible coupling members, e.g. compatible with the toy construction system, so as to allow the electronic toy to be detachably attached to the accessory construction element. Hence, in this embodiment, the electronic toy with the accessory construction element attached to it may be moved around by a user as a coherent structure.

At the start of a play activity or during an ongoing play activity, the user brings the electronic toy 110 in contact (or at least proximity) to an accessory construction element 120 which includes a marker 121 such that the electronic toy 110 detects the accessory construction element 120 and recognizes the marker of the accessory construction element when the electronic toy is brought into contact with (or proximity of) the accessory construction element. When the electronic toy together with the accessory construction element 120 is moved about the physical play environment, the electronic toy detects the corresponding movement and detects whether the electronic toy remains in contact with (or proximity of) the accessory construction element during the detected movement. The electronic toy provides user-detectable feedback, e.g. audible feedback or visual feedback responsive to the detected movement and to the detection of either continued contact between the electronic toy and the accessory construction element or an interruption of the contact. The latter may occur when the electronic toy falls off the accessory construction element or is otherwise displaced from the accessory construction element as a result of the movement, of an impact resulting from the movement, etc. To this end, the electronic toy may comprise a display 111, a loudspeaker and/or other suitable user-interface. The type of feedback may further depend on the detected marker, i.e. different accessory construction elements (recognizable by different markers) may result in different reactions to the same movements. When the play environment 100 of FIG. 5 is used as a part of a play activity described in connection with one of FIGS. 1 through 4, the processing unit of the electronic toy may further update a result score depending on the detected movement and to the detection of either continued contact between the electronic toy and the accessory construction element or an interruption of the contact.

In the example of FIG. 5, the electronic toy 110—while in contact with the accessory construction element 120, e.g. while attached accessory construction element—may slide down a slide with a structured surface, the sliding movements and vibrations caused by the structured surface cause the electronic toy to provide a corresponding audible and/or visible feedback. In embodiments where the electronic toy is not firmly attached to the accessory construction element, i.e. such that the electronic toy may easily be disconnected from the accessory construction element during the sliding movement, the feedback may further depend on the whether the electronic toy remains in contact with the accessory construction element, i.e. whether the reader continues to detect the marker 121 during the detected movement. For example, a computed result score may only be increased when the sliding movement is detected for a certain period of time without the electronic toy falling off the accessory construction element during the movement.

Figure 6:
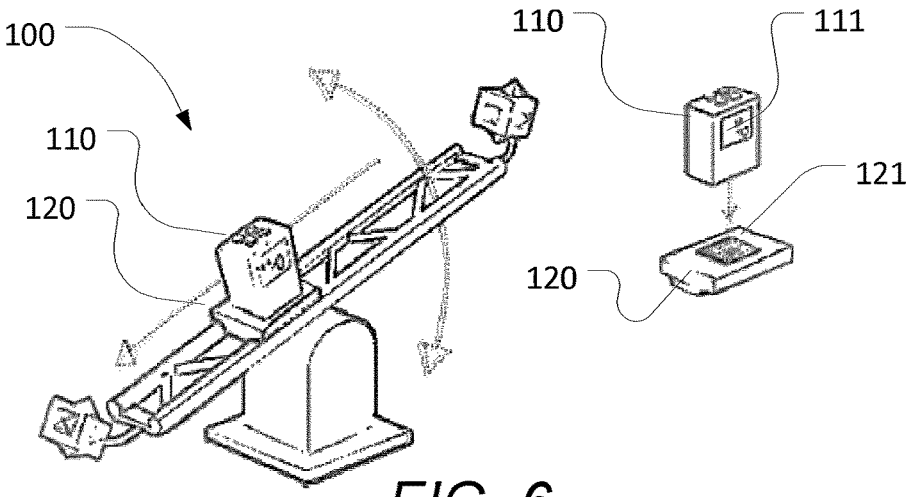

FIG. 6 illustrates another example of a toy system comprising a physical play environment 100 constructed from toy construction elements. The system further comprises an electronic toy 110 and an accessory construction element 120 with a marker 121 such that the electronic toy 110 can be brought into contact with, e.g. attached to, the accessory construction element 120 and detect ongoing contact during movement of the electronic toy, all as described in connection with FIG. 5.

However, in the example of FIG. 6, the play environment is a seesaw on which the accessory construction element can be slidably attached such that the electronic toy can be placed on (or otherwise be brought into contact with) the accessory construction element and such that the electronic toy with the accessory construction element can slide back and forth along the pivoting board of the seesaw when the board pivots back and forth. The electronic toy detects the sliding movement and/or the impact when reaching the end of the board. The electronic toy may then create audible and/or visible feedback and/or compute a result score responsive to the detected movements. For example, the electronic toy may compute a result score that depends on the speed of the reciprocating movement, on the number of impacts and/or on the time the electronic toy remains in contact with the accessory construction element without falling off. In one particular example, in order to obtain a high result score, the player may be required to let the electronic toy slide back and forth on the board for a period of time without the electronic toy impacting the end of the board and without the electronic toy falling of the accessory construction element.

Hence, generally, the processing unit of the electronic toy may control its user-interface and/or compute a result score responsive to a detected type of marker, one or more attributes of a detected movement and responsive to a continued detection of said marker during the detected movement.

Figure 7:
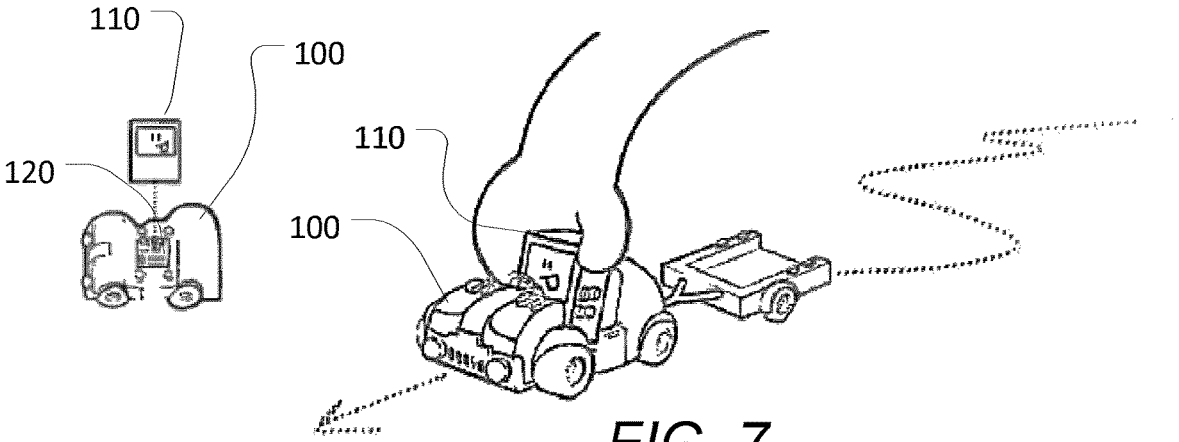

FIG. 7 illustrates yet another example of a toy system comprising an electronic toy 110 and an accessory construction element 120, as described in connection with FIG. 5.

However, in the example of FIG. 7, the accessory construction element 120 is a part of a toy construction model 100 resembling a vehicle, e.g. one of a plurality of toy construction elements from which the toy construction model is constructed. Alternatively, the vehicle may be formed from a single toy construction element including a marker. When the electronic toy is placed in the vehicle, the electronic toy detects a marker of the accessory construction element. When the user moves the vehicle with the electronic toy around, the electronic toy detects the movement of the car and creates audible and/or visible feedback responsive to the detected movements.

Figure 8:
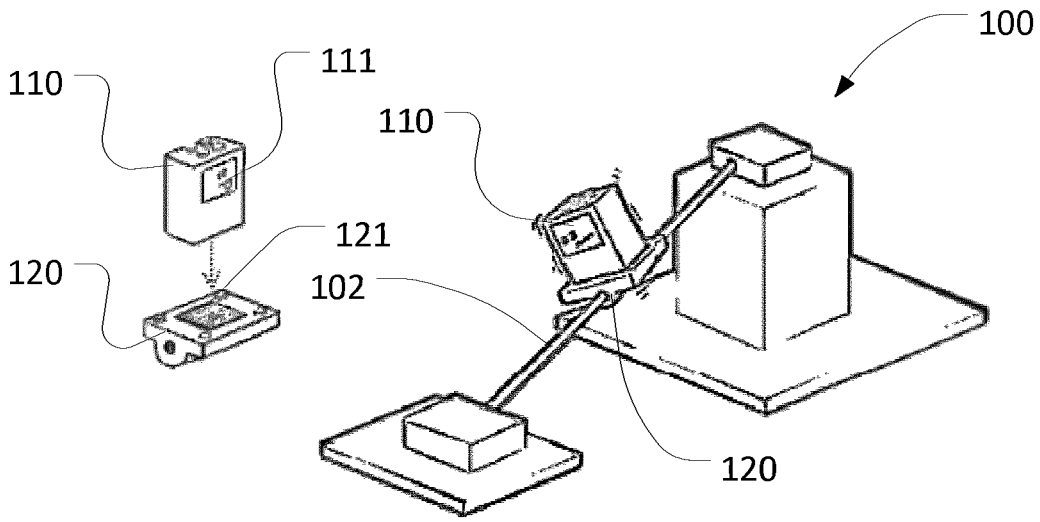

FIG. 8 illustrates another example of a toy system comprising a physical play environment 100 constructed from toy construction elements. The toy system further comprises an electronic toy 110 and an accessory construction element 120, all as described in connection with FIGS. 5 and 6.

However, in the example of FIG. 8, the play environment comprises a suspended rope or a pole 102 along which the accessory construction element 120 can slide while pivoting back and forth. The electronic toy 110 detects the sliding movement and the pivoting motion and creates audible and/or visible feedback responsive to the detected movements.

Hence, even though the accelerometer may not be able to detect the difference between sliding down an inclined plane and sliding back and forth on a seesaw, etc. the electronic toy may still react in a different manner when in contact with different accessory construction elements, thus providing a rich variety of play experiences with only few and relatively inexpensive sensors.

Figure 9:
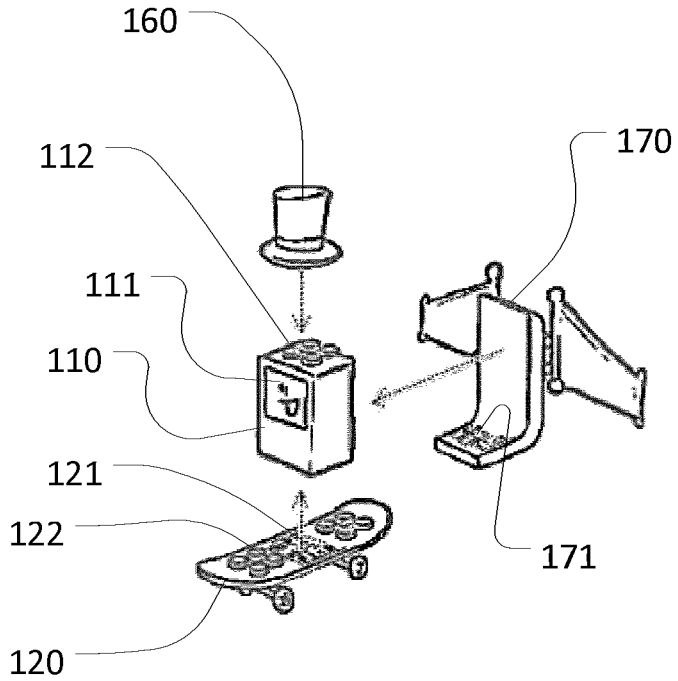

FIG. 9 illustrates how an electronic toy 110 as described herein may be connected to one or more accessory construction elements 120, 160, 170, respectively. To this end, the electronic toy may have coupling members 112 compatible with a toy construction system. Similarly, the accessory toy construction elements have corresponding, mating coupling members 122, 171. The electronic toy 110 may detect attachment of some or all of the accessory toy construction elements, e.g. by means of markers 121, micro-switches of the electronic toy which a configured to be engaged by the accessory toy construction elements when attached to the electronic toy, and/or by another suitable detection mechanism. The electronic toy 110 comprises an accelerometer or similar sensor and a camera, a color sensor or other reader for reading a marker. The reader is configured to face downwards, i.e. to detect a marker onto which the electronic toy is positioned. The electronic toy further comprises a display 111 and a loudspeaker for providing visual and audible feedback responsive to detected movements of the electronic toy and to detected markers, all as described above.

Figure 10:
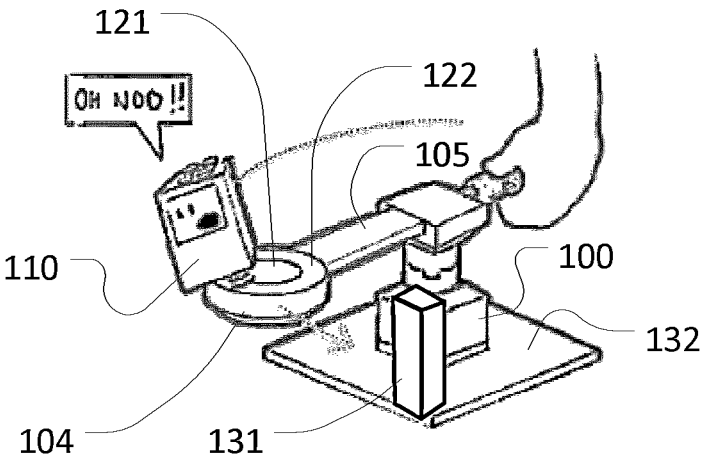

FIG. 10 illustrates yet another example of a toy system comprising an electronic toy 110 and a toy construction model 100 forming a physical environment. In this example the toy construction model 100 resembles a carousel comprising a rotatably mounted arm 105 having a platform 104 at one of its ends. The platform 104 thus includes, or functions as, an accessory construction element. The electronic toy may be positioned on the platform such that the electronic toy may slide across the platform and even fall off the platform, when the platform is rotated. The upper surface of the platform may include one or multiple markers 121, e.g. in the form of concentric rings having different colors. Hence the electronic toy 110 may detect its position on the platform (e.g. its radial position relative to the center of the platform) as well as its own movement. The electronic toy may thus create audible and/or visible feedback (and/or compute a result score) responsive to the detected movements and responsive to whether the electronic toy detects that it is and remains positioned on the platform. The electronic toy may even create feedback and/or compute a result score responsive to is position on the platform, e.g. whether electronic toy is positioned centrally on the platform or close to the periphery of the platform. It will be appreciated that a detection of a position, e.g. a position on a surface, may also be detected using two or more types of markers, each indicative of a respective position.

In the example of FIG. 10, the toy system further comprises a column 131 with which the platform 104 or another of the movable parts of the toy construction model 100 can collide during its movement. It will be appreciated that the toy system may include a different type of structure or mechanism with which the movable part of the toy construction model may interact. The electronic toy may detect an impact resulting from such a collision. Alternatively or additionally, the electronic toy may deduce the impact from the detection of a continued rotation of the arm 105 based on knowledge of the shape of the toy construction model and relative position of the toy construction model and the column, i.e. without necessarily having to detect the impact of the collision. Such a determination is facilitated when the column 131 is connected with the electronic toy construction model in a predetermined manner, e.g. when the column 131 and the toy construction model are both attached to a common support structure, e.g. a common base plate 132 of the toy construction system.

Hence, the system of FIG. 10 is an example of an embodiment, where the toy system comprises a functional toy construction model including one or more movable parts that are movable relative to one or more other parts of the toy construction model and that include an actuator configured to interact with another part of the toy system, e.g. with another part of the same or of a separate toy construction model. The electronic toy is configured to be moved together with the movable part, while in contact with a marker of the movable part. Accordingly, the electronic toy may be configured to determine—based on the detection of the marker and based on a detected movement of the electronic toy—that the movable actuator has interacted with (or at least is expected to have interacted with) said other part of the toy system. The electronic toy may thus be configured to create an audible and/or visible feedback responsive to the determined actuation.

It will be appreciated that in this and other embodiments, detection of the movement may include detection of movement parameters, such as speed, duration, direction, of the movement. The determination of the movement may even include detection of more complicated movement patterns, such as detection of a rotation or reciprocating movement, optionally including detection of a frequency of the reciprocating movement, or a certain sequence of different movements, e.g. of different directions, speed, etc. or of an linear movement followed by an impact, etc. The electronic toy may thus create the feedback and/or the compute a result score responsive not only to a determination that a movement has been detected but also responsive to detected parameters/attributes of the detected movement, e.g. dependent on whether the detected parameters/attributes fulfill one or more criteria, such as one or more predetermined criteria.

Figure 11:
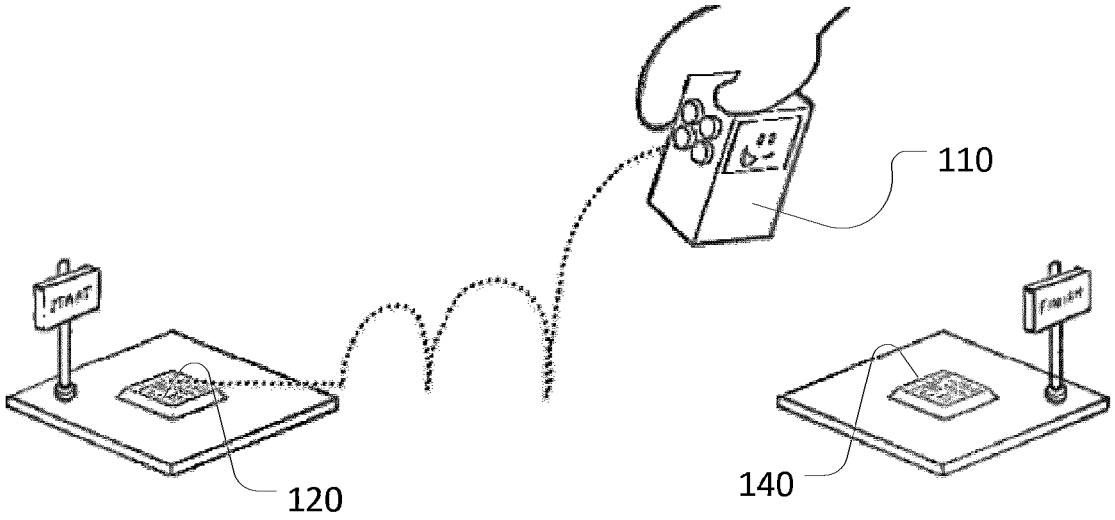

FIG. 11 illustrates yet another example of a toy system, similar to the systems of FIGS. 1-4. However, in the example of FIG. 11, the physical environment only includes two markers, namely the start marker 120 and the finish marker 140. Hence, in this example, the score is computed solely based on the detected movements (and optionally based on elapsed time or other game parameters, e.g. a progression level, but not based on detected additional markers) while the electronic toy is in its active play state, i.e. between detecting the start marker and detecting the finish marker.

Figure 12A:
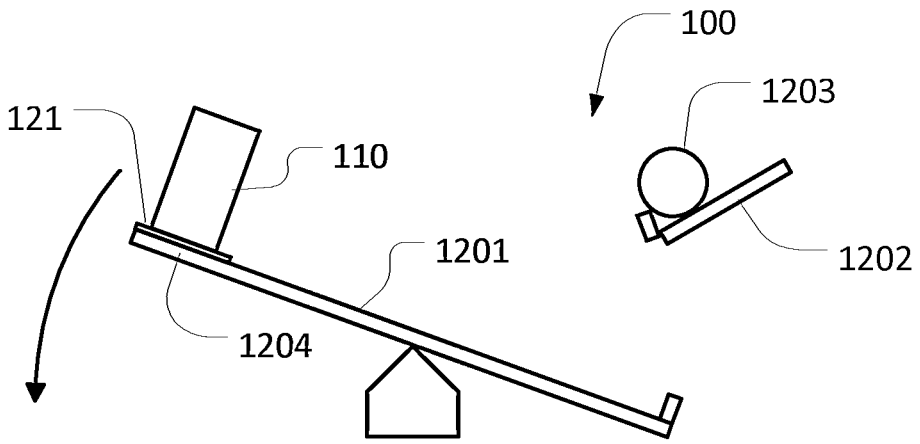
Figure 12B:
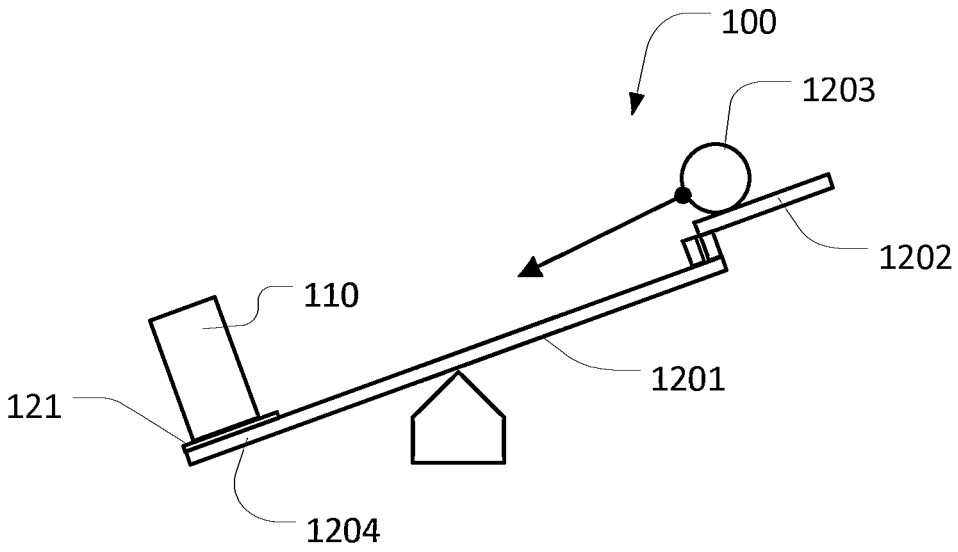

FIGS. 12A-B illustrate yet another example of a toy system, similar to the system of FIG. 10 in that the toy system comprises a physical play environment 100, e.g in the form of a toy construction model. The toy system further comprises an electronic toy 110 as described herein and in that the toy system is configured such that a electronic toy can infer a functional behavior of a physical toy construction model from a detected marker and a detected movement of the electronic toy.

In this example, the physical play environment 100 includes a toy construction model including a seesaw 1201 and a ramp 1202 for discharging a ball 1203. In particular, the seesaw is configured to pivot between a first position—illustrated in FIG. 12A—and a second position, illustrated in FIG. 12B. When the seesaw 1201 is in the first position the ramp 1202 blocks the ball 1203 from rolling off the ramp. When the seesaw is in its second position, it actuates the ramp so as to allow the ball to role down the ramp onto a first end of the seesaw and along the seesaw towards a second end of the seesaw, opposite the first end.

The seesaw includes a platform 1204 at its second end. The platform is configured to receive and retain the electronic toy 110. For example, the platform may include a recess for receiving the electronic toy or coupling members to which the electronic toy may be detachably attached. The platform further comprises a marker 121 allowing the electronic toy to detect that it is positioned on the platform of the seesaw.

In operation, the electronic toy is configured to:

- detect, using the reader of the electronic toy, that it is positioned on the platform 1204,
- detect, using its accelerometer or similar sensor for detecting movement, the pivoting motion of the seesaw
- to detect when the seesaw is in its second position (e.g. based on the detected pivoting motion alone or by detecting an impact when the first end of the seesaw interacts with the ramp)
- create a visible and/or audible feedback at a predetermined delay time after the electronic toy has detected that the seesaw is in its second position, the delay time corresponding to the time required for the ball to role down the ramp and the seesaw and reach the position of the platform.

Accordingly, the electronic toy may simulate a detection of being hit by the ball without having to actually detect the hit per se.

Figure 13:
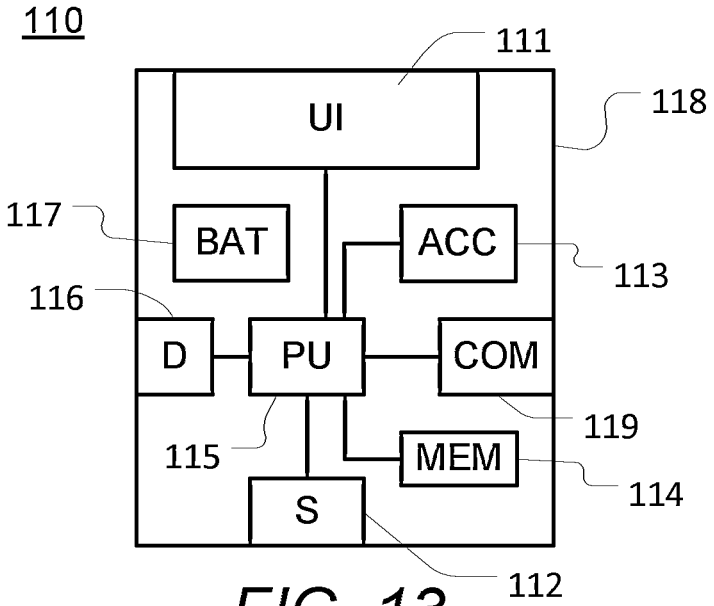
FIG. 13 shows a schematic block diagram of an example of an electronic toy for a toy system as described herein.

FIG. 13 shows a schematic block diagram of an example of an electronic toy for a toy system as described herein. The electronic toy, generally designated by reference numeral 110, comprises a housing 118 accommodating the various electronic components of the electronic toy. The housing may be made from a suitable material, such as plastic. The housing may have a shape corresponding to the play experience. For example, the housing may resemble a toy figurine, a toy robot, a toy vehicle, a toy animal or another type of toy. The housing may have any suitable size, preferably such that it can conveniently carried and manipulated by a child.

The electronic toy comprises a number of electronic components which may all be accommodated within the housing. In particular, the electronic toy comprises

- an accelerometer 113 or other type of sensor for detecting movement of the electronic toy;
- a reader 112 for detecting markers in a proximity of the electronic toy;
- a user-interface 111 for providing a user-perceptible output;
- a processing unit 115 configured to control the user-interface responsive to a detected movement and to a detected marker.

The accelerometer 113 may be a multi-axes accelerometer, such as a triaxial accelerometer or a 6-axis accelerometer so as to allow detection of movements in various directions and to at least approximately measure derive attributes of such motion, such as speed, direction, distinguish linear motion, rotational motion, reciprocating motion, impacts, etc.

The reader 112 comprises an optical sensor for detecting visual markers such as color codes or individual colors. Alternatively or additionally, the optical sensor may be configured to detect insignia, QR codes, micro-dot codes or other machine-readable codes or optically detectable and recognizable features. The optical sensor may comprise one or more color sensors, e.g. an array of color sensors. In some embodiments, the optical sensor comprises a camera. In alternative embodiments, the reader may comprise an RFID reader or a different type of readers for reading markers employing other types of detection mechanism.

The user-interface 111 includes a display and an audio output. Alternatively or additionally, the user-interface may include other output devices for providing visual and/or audible and/or tactile output. The user-interface may further comprise one or more input devices allowing a user to provide user input. Such input devices may include physical input devices such as buttons, touch pads etc. or they may be provided as activatable user-interface elements provided by a touch-sensitive display or the like.

The processing unit 115 may include a suitably programmed microprocessor or any other circuit and/or device suitably adapted to perform the data- and/or signal-processing functions described herein. In particular, the processing unit may comprise a general- or special-purpose programmable microprocessor, such as a central processing unit (CPU), a digital signal processing unit (DSP), an application specific integrated circuits (ASIC), a programmable logic arrays (PLA), a field programmable gate array (FPGA), a special purpose electronic circuit, etc., or a combination thereof. The processing unit 115 is configured to receive sensor data from the accelerometer 113 and from the reader 112 and to control the user-interface 111 responsive to the received sensor data. In particular, the processing unit may implement a state machine where the processing unit can operate in an active play state, a stand-by state a free-play state, and/or the like as described herein and to compute result scores of play activities and/or generate user-perceptible outputs based on detected markers and movements.

In the present example, the electronic 110 toy further comprises an accessory detector 116, a memory 114, a communications interface 119 and a battery 117. It will be appreciated, however, that other examples of an electronic toy may be implemented without these components or with only some of them. Similarly, some embodiments of an electronic toy may include alternative or additional components.

The accessory detector 116 may be configured to detect whether one or more accessories are attached to the electronic toy 110, e.g. items of clothing or the like. The accessory detector may include an RFID reader, microswitches, electrical contacts and/or the like. The processing unit may receive information about attached accessories from the accessory detector and further base the created output on the received information.

The memory 114 may include an EEPROM, a RAM, a solid-state data storage device or another suitable data storage device. The memory may have stored thereon program code to be executed by the processing unit and/or game-related data, such as information on game progression, previous result scores, etc.

The communications interface 119 may be a wired or wireless interface, e.g. using RF communication such as Bluetooth LE or another suitable wireless or wired communications technology allowing the electronic toy to communicate with another electronic toy and/or with an external data processing device such as a tablet computer, a smartphone or the like.

The battery 117 may be a conventional battery, a rechargeable battery or another suitable energy storage device for providing the electronic components of the electronic toy with electric operating power.

Figure 14:
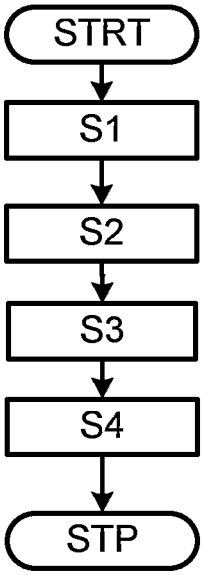
FIG. 14 shows a flow diagram of an example of a process as described herein.

FIG. 14 shows a flow diagram of an example of a process as described herein.

In step S1, the electronic toy detects a start marker and enters an active play state.

In step S2, while in the active play state, the electronic toy reads sensor data from the accelerometer and the reader and controls the user-interface responsive to the received sensor data. The electronic toy also maintains a result score that is computed based on the received sensor data.

In step S3, the electronic toy detects a finish marker or receives another trigger causing the electronic toy to exit the active play state. Examples of other triggers include the expiry of a timer indicative of a maximum duration for a play activity.

In step S4, the electronic toy creates an audible and/or visible output indicative the final result score. The electronic toy may further update a progression level or other game data responsive to the result score.

The invention claimed is:

1. An electronic toy comprising:

a sensor for detecting movement of the electronic toy;

a reader for detecting markers in a proximity of the electronic toy;

a user-interface for providing a user-perceptible output; and a processing unit configured to:

control the user-interface responsive to a detected movement and a detected marker;

enter an active play state responsive to a first trigger event representative of a start of a play activity, wherein the first trigger event includes detection by the reader of a first marker, the first marker being representative of a start of a play activity;

process information about movements detected by the sensor while the processing unit is in the active play state and information about markers detected by the reader while the processing unit is in the active play state to compute a result score associated with the play activity;

control the user-interface to provide a user-perceptible output based on the computed result score; and exit the active play state responsive to a second trigger event representative of an end of a play activity, wherein the second trigger event includes detection by the reader of a second marker, the second marker being representative of an end of a play activity.

2. The electronic toy according to claim 1, wherein:

the electronic toy is configured to perform different types of play activities;

the first trigger event is further indicative of a type of play activity; and the computed result score and the user-perceptible output depends on the type of play activity.

3. The electronic toy according to claim 1, wherein:

the user-interface includes one or more user-interface elements, and the processing unit is configured to enter the active play state responsive to a first user-activation of at least one of the one or more user-interface elements, the first user-activation configured to start a play activity or exit the active play state responsive to detecting a second user-activation of at least one of the one or more user-interface elements, the second user-activation being representative of an end of a play activity.

4. The electronic toy according to claim 1, wherein the processing unit is configured to compute the result score and to control the user-interface based on a detected temporal relation between a detected movement of the electronic toy and a detected marker.

5. The electronic toy according to claim 1, wherein the processing unit is configured to compute the result score and to control the user-interface based on one or more attributes of a detected movement and responsive to a continued detection of said marker during the detected movement.

6. The electronic toy according to claim 1, wherein the first and second markers include an RFID tag or a visually detectable marker.

7. The electronic toy according to claim 6, wherein a visually detectable marker is selected from the group consisting of: a QR code, a predetermined color, a color code, a micro-dot pattern, and a recognizable insignia.

8. The electronic toy according to claim 1, further comprising one or more accessories configured to detachably connect to the electronic toy, the electronic toy configured to detect the one or more accessories when connected thereto, the one or more accessories configured to influence the first trigger event, the second trigger event, the active play state, or the computation of the result score.

9. A toy system comprising:

a physical play environment constructed from toy construction elements; and an electronic toy configured to move about the physical play environment, the electronic toy including:

a sensor configured to detect movements of the electronic toy;

a reader configured to detect markers; and a processing unit configured to:

enter an active play state responsive to a first trigger event representative of a start of a play activity, wherein the first trigger event includes detection by the reader of a first marker, the first marker being representative of a start of a play activity;

process information about movements detected by the sensor while the processing unit is in the active play state and information about markers detected by the reader while the processing unit is in the active play state to compute a result score associated with the play activity; and exit the active play state responsive to a second trigger event representative of an end of a play activity, wherein the second trigger event includes detection by the reader of a second marker, the second marker being representative of an end of a play activity.

10. The toy system according to claim 9, further comprising a functional toy construction model within the physical play environment, the functional toy construction model including a first part and a second part, the first part being movable relative to the second part, the first part including a first marker, wherein:

the electronic toy is configured to be moved together with the first part, the processing unit is configured to detect the first marker while the electronic toy is moved with the first part and to detect movement of the electronic toy, and the processing unit is configured to create an audible output, visible output, or to compute a result score responsive to the detected interaction.

11. The toy system according to claim 9, further comprising a first functional toy construction model within the physical play environment, the first functional toy construction model including at least a first part and a second part, the first part being movable relative to the second part, the first part including a first marker and an actuator configured to interact with the first or a second functional toy construction model, wherein:

the electronic toy is configured to be moved together with the first part, the processing unit is configured to detect an interaction between the actuator and the first or second functional toy construction model, the interaction based on a detection of the first marker while the electronic toy is moved with the first part and based on a detected movement of the electronic toy, and the processing unit is also configured to create an audible output, visible output, or to compute a result score responsive to the detected interaction.

12. A method of playing an interactive game, the method comprising:

providing toy construction elements for creating a physical play environment;

providing an electronic toy configured to move about the physical play environment, wherein the electronic toy is configured to detect:

a first marker to enter an active play representative of a start of a play activity;

movements made by the electronic toy within the physical play environment;

one or more second markers positioned within the physical play environment during active play; and a third marker to exit the active play state representative of an end of a play activity, wherein the electronic toy is configured to compute a result score based on the play activity.

* * * * *